United States Patent [19]

Helmer et al.

[11] 3,966,484

[45] June 29, 1976

[54] COMPOSITION FOR SIZING CELLULOSE FIBERS

[75] Inventors: Karin Ulla Elisabet Helmer, Solna; Alf Ragnar Reuterhäll, Gustavsberg, both of Sweden

[73] Assignee: Kemanord Aktiebolag, Stockholm, Sweden

[22] Filed: Mar. 24, 1975

[21] Appl. No.: 561,562

Related U.S. Application Data

[62] Division of Ser. No. 271,858, July 14, 1972, Pat. No. 3,887,427.

[52] U.S. Cl. ..... 106/287 R; 8/120; 8/181; 8/184; 260/224; 162/158

[51] Int. Cl.[2] ..... D21D 3/00; C07C 125/03

[58] Field of Search ..... 106/287; 260/544 C; 8/120, 181, 127.6; 162/158 N

[56] References Cited

UNITED STATES PATENTS

| | | | |
|---|---|---|---|
| 2,824,779 | 2/1958 | Reeves et al. | 260/231 A |
| 2,883,357 | 4/1959 | Hardy | 260/42.16 |
| 3,567,360 | 3/1971 | Pierce et al. | 8/184 |
| 3,887,427 | 6/1975 | Helmer | 162/158 N |

*Primary Examiner*—Theodore Morris
*Attorney, Agent, or Firm*—Fred Philpitt

[57] ABSTRACT

The present invention relates to a composition for the sizing of materials containing cellulosic fibers (e.g. paper) by the use of carbamoyl chlorides.

4 Claims, No Drawings

COMPOSITION FOR SIZING CELLULOSE FIBERS

RELATED CASE

This application is a division of Ser. No. 271,858 filed 7/14/72 now U.S. Pat. No. 3,887,427.

BACKGROUND

"Sizing" refers to the treatment of either cellulosic pulp fibers or an already formed cellulosic material with chemicals which control the wettability and surface properties of the final cellulosic product.

Paper frequently is sized with resinates which are fixed to the cellulose fibers by means of aluminum sulphate (alum). Another well known sizing agent which is fixed by means of reacting with the hydroxyl groups of the cellulose is based on alkyl ketene dimers. This agent is usually added to the stock dispersed in a cationic emulsifier. Alkylketene dimers have certain advantages over resinates. One advantage is that the pH of the stock is kept within the range of 7 – 8 compared to a pH range of 4.5 – 6.5 which is used when the resinates are used as sizes — which among other things imparts improved aging properties to the paper and makes it possible to use alkaline fillers, such as calcium carbonate. Furthermore, considerably lesser amounts of ketene dimers are required to obtain a certain degree of hydrophobicity and the sizing thus obtained is permanent. Moreover the paper will have improved resistance to lactic acid, ink, etc.

A disadvantage when employing alkylketene dimers is that no complete sizing effect is achieved until curing of the material for example by storing at room temperature for about 48 hours or by heating to a temperature of 100°C for 20 minutes. Another disadvantage is that the sizing with alkylketene dimers is sensitive to alum present in the stock.

It also has been previously known to employ anhydrides of carboxylic acids as sizing agents, such as anhydrides of stearic acid or alkyl succinic acid. Said anhydrides do not have any of the above mentioned disadvantages that are encountered when employing resinates and ketene dimers, but greater amounts of the anhydride additives are required in order to achieve the same sizing effect as with the ketene dimers. In order to enhance the sizing effect it is common to add catalysts to the anhydrides so these catalysts are called sizing promoters and are used in relatively large amounts in combination with the anhydrides.

THE INVENTION BROADLY

The present invention involves sizing materials containing cellulosic fibers by bringing such cellulosic materials into contact with at least one carbamoyl chloride having the general formula

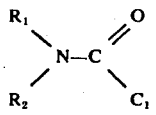

where $R_1$ is an organic, hydrophobic hydrocarbon group comprising 8 – 40 carbon atoms and $R_2$ is hydrogen, lower alkyl or has the same meaning as $R_1$.

THE MATERIALS CONTAINING CELLULOSIC FIBERS

The cellulosic fibers can be present in the form of a water suspension or in a more concentrated form, such as paperboard, fiberboard, or particle board, or they can be included or admixed with other materials such as semi-synthetic paper containing plastics in addition to the cellulosic fibers.

THE CARBAMOYL CHLORIDE

As noted above, the carbamoyl chloride has the general formula

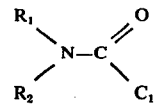

where $R_1$ is an organic, hydrophobic hydrocarbon group comprising 8 – 40 carbon atoms and $R_2$ is hydrogen, lower alkyl or has the same meaning as $R_1$. Examples of suitble hydrophobic groups are (a) a higher alkyl having between 8 and 40 carbon atoms (such as decyl, undecyl, dodecyl, tridecyl, tetradecyl, pentadecyl, hexadecyl, octadecyl, tetracosyl, and pentacosyl) although those having about 12 – 30 carbon atoms are generally preferred, (b) the corresponding alkenyl groups having between 8 and 40 carbon atoms (such as decenyl, tridencenyl, heptadecenyl, octadecenyl, eicosenyl, tricosenyl etc.) (c) aralkyl, alkaryl, and alkyl substituted cycloalkyl having at least 8 carbon atoms (e.g. 4-tert.butylphenyl, octylphenyl, dinonylphenyl, dodecylphenyl, tridecylphenyl, pentadecylphenyl, octadecylphenyl, heneicosylphenyl, nonylcyclopropyl, dodecylcyclobutyl, tridecylcyclopentyl, tetradecylcyclohexyl, pentadecylcycloheptyl, octadecyl cyclohexyl etc.) and (d) any of the aforementioned alkyl alkenyl alkaryl and alkylcycloalkyl groups containing noninterfering, inert substituents. Of the inert substituents may be mentioned ether, carboalkoxy, alkyloxy, aryloxy, arylalkyloxy, keto(carbonyl)-tert. amide groups etc. Examples of radicals which should not be present to any great extent in the hydrophobic group may be mentioned e.g. hydroxyl groups, primary and secondary amino groups, unstable halogenes, and carboxyl groups or other acidic groups. To those skilled in the art it is obvious which groups should be employed if undesired side reactions are to be avoided.

$R_1$ preferably is an alkyl group comprising 12 – 30 carbon atoms and $R_2$ is hydrogen, lower alkyl or has the same meaning as $R_1$.

The carbamoyl chlorides can be prepared according to known methods for instance by phosgenisation of the corresponding amines.

The advantages of the present invention are not dependent on what method is chosen to bring the carbamoyl chloride into contact with the cellulosic fibers. According to one method an agueous suspension of cellulose fibers can be brought into contact with the carbamoyl chloride, which optionally can be dispersed in a suitable way. A solution or dispersion of the carbamoyl chloride chloroformate also can be brought into contact with a material containing cellulose fibers, such as paper.

The carbamoyl chlorides which are employed in the process of the present invention show a certain cationic activity and consequently retention to the cellulose fibers. Thus for certain purposes some additional retention agent may be omitted, e.g. for surface sizing or dipping concentrated cellulose fibers such as paper board, particle board, etc. However, when the carbamoyl chloride is added to an aqueous suspension of cellulose fibers it is frequently desirable to employ a dispersion of the carbamoyl chlorides, and thus use an emulsifier in combination with the carbamoyl chloride compounds. For the preparation of a dispersion an emulsifier having anionic, cationic or nonionic properties or a mixture of these may be used. Especially preferred emulsifiers are the cationics, e.g. polyethylene imines, polyalkylene polyamide resins, cationic starches etc. A special type of emulsion agent showing a good retention to the fibers are quaternary ammonium compounds or aminohydrochlorides containing at least one alkyl group having 8 – 22 carbon atoms, such as dimethyldistearyl aminochloride or dimethylstearyl aminohydrochloride. The amount of the emulsifier should exceed 0.05% by weight based on the dry fibers, and preferably 0.1 – 10% by weight based on the carbamoyl chloride.

The carbamoyl chlorides according to the invention are employed in an amount exceeding 0.001 percent by weight based on the dry fibers by addition to the stock of fibers or by surface sizing of paper. The upper limit is not critical and is only limited by economical considerations. Preferably the amount of the carbamoyl chloride should fall within the range of from 0.001 to 5 percent by weight, most preferably 0.005 to 0.5 percent by weight based on the dry fibers. The fiber suspension or the concentrated fibers may also contain other additives commonly used in the manufacturing of paper, paperboard, fiberboard, particle board, etc. such as alum, fillers, pigments, retention agents, foam quentching agents, etc.

The present invention will now be described more in detail in the following examples which are given for illustration but are not intended to restrict the invention. Percentages and parts are by weight, unless otherwise specified.

EXAMPLE 1

Unsized paper sheets having a surface weight of about 70 g/m² were formed from a bleached sulphate pulp beaten to about 30° SR at a pH of 8.0 in a laboratory sheet machine. The sheets were dried and conditioned (at 20°C and 65% relative humidity). The sheets then were impregnated by submerging them in a solution of 0.1% of substituted carbamoyl Chloride in benzene for a few seconds and the excess of the solution was adsorbed. The impregnated sheets were dried at a temperature of 60°C for 40 minutes and cured at 105° for 30 minutes. After conditioning the Cobb-number was determined according to the norm SCAN-P 12:64, which is a measure of the water absorbtivity of the sheets. (The Cobb number for unsized paper is 100).

| Type of substituent | melting point °C | % sizing agent based on weight of dry fibers | $Cobb_{60}$ g/m² |
|---|---|---|---|
| $R_2 = CH_3$<br>$R_1 = C_{16}H_{33}$ | 67–69 | 0.015 | 20 |
| $R_1 = R_2 = C_{18}H_{37}$ | 56–58 | 0.015 | 18 |
| $R_2 = C_{16}H_{33}$<br>$R_1$ = cyclohexyl | 54–56 | 0.015 | 22 |
| $R_2 = C_{18}H_{37}$<br>$R_1$ = phenyl | 101–103 | 0.015 | 22 |
| $R_2 = CH_3$<br>$R_1 = CH_3—(CH_2)_{16}—O—(CH_2)_3$ | 39–42 | 0.020 | 24 |
| $R_2 = CH_3$<br>$R_1 = C_{10}H_{21}$ | <20 | 0.20 | 21 |
| $R_1 = R_2 = C_{12}H_{25}$ | <20 | 0.10 | 20.5 |
| $R_2 = CH_3$<br>$R_1 = C_{14}H_{29}$ | <20 | 0.05 | 22.5 |

EXAMPLE 2

10 g of a carbamoyl chloride $R_1 = R_2 = C_{18}H_{37}$, were melted at 60°C and then 90 g distilled water (60° C) were added during homogenization for 5 minutes. The emulsion was thereupon rapidly cooled to 25°C to give a stable dispersion.

EXAMPLE 3

10 g of a carbamoyl chloride $R_1 = R_2 = C_{18}H_{37}$ and 0.5 g of a stearylamine hydrochloride were melted together at 60°C, then 89.5 g of distilled water (60°C) were added during homogenization for 5 minutes. The emulsion was rapidly cooled to 25°C to give a stable dispersion.

EXAMPLE 4

10 g of carbamoyl chloride $R_1 = R_2 = C_{18}H_{37}$, and 0.5 g of distearyldimethyl ammonium chloride were melted together and then 89.5 g distilled water (60°C) were added during the homogenization for 5 minutes. The emulsion was then rapidly cooled to 25°C to give a stable dispersion.

EXAMPLE 5

10 g of carbamoyl chloride $R_1$ 32 $R_2 = C_{18}H_{37}$ were melted and then 90.0 g of distilled water (60°C) containing 0.5 g of a water-soluble cationic polyacrylamide were added during the homogenization for 5 minutes. The emulsion then was rapidly cooled to 25°C to give a stable dispersion. The obtained dispersions thereafter were used as sizing agents for paper in the same manner as described in Example 1. The results are shown in the following table: (The Cobb number for unsized paper is 100).

| Sizing agent according to Example | %carbamoyl chloride based on dry fiber | $Cobb_{60}$ g/m² |
|---|---|---|
| 2 | 0.2 | 22 |
| 3 | 0.2 | 20 |
| 4 | 0.2 | 20 |
| 5 | 0.2 | 22 |

EXAMPLE 6

A dispersion as defined in example 2 was added to a suspension of cellulose fibers in water together with a cationic polyacrylamide having a molecular weight of more than 1,000,000.

EXAMPLE 7

A dispersion as defined in example 2 was added to a suspension of cellulose fibers in water together with an anionic polyacrylamide having a molecular weight of more than 1,000,000.

EXAMPLE 8

A dispersion as defined in example 2 was added together with a cationic polyacrylamide having a high molecular weight to a suspension of cellulose fibers in water pre-treated with an anionic polyacrylamide having a molecular weight of more than 1,000,000. The cellulose fiber suspension according to examples 6–8 were then drained and sheets were produced in a laboratory sheet machine. The sheets were dried for 40 minuets at 60°C and were cured for 30 minutes at 105°C. After conditioning, the Cobbnumber according to the norm SCAN-P 12:64 was determined. The results are shown in the following table:

| Sizing system according to example | Amount of cationic polymer based on dry fiber weight | Amount of anionic polymer based on dry fiber weight | Amount of sizing agent based on dry fiber weight | $Cobb_{60}$ g/m² |
|---|---|---|---|---|
| 6 | 0.02 | | 0.30 | 24 |
| 7 | | 0.02 | 0.25 | 22 |
| 8 | 0.02 | 0.02 | 0.30 | 24 |

The tests show that no substantial improvement in sizing was obtained by adding a retention agent. (The Cobb number for unsized paper is 100).

EXAMPLE 9

In manufacturing of a porous fiberboard 0.20% of methylstearyl carbamoyl chloride were added to the stock based on the dry fiber weight. The board panels were dried for 2 hours at 20° – 160°C at a continuously elevating temperature.

The water absorption of the board panels was determined according to the norm SLS 235105 whereby test specimens having the dimensions of 100 × 100 × 10 mm were submerged in water for 2 hours. The standard rate of absorption during large scale production of boards varied from 155 and 300% depending on the curing condition. The following results were obtained

| | % water absorption |
|---|---|
| Reference | 180 |
| Sized board as described above | 35 |

More or less detailed claims will be presented hereinafter and even though such claims are rather specific in nature, those skilled in the art to which this invention pertains will recognize that there are obvious equivalents for the specific materials recited therein. Some of these obvious equivalents are disclosed herein, other obvious equivalents will immediately occur to one skilled in the art and still other obvious equivalents could be readily ascertained upon rather simple, routine, non-inventive experimentation. Certainly no invention would be involved in substituting one or more of such obvious equivalents for the materials specifically recited in the claims. We intend that all such obvious equivalents be encompassed within the scope of this invention and patent grant in accordance with the well-known doctrine of equivalents, as well as changed proportions of the ingredients which do not render the composition unsuitable for the disclosed purposes.

What we claim is:

1. A sizing agent for material containing cellulosic fibers comprising an aqueous dispersion of an effective emulsifying amount of an emulsifier and a carbamoyl chloride having the following general formula

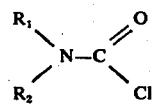

wherein $R_1$ is an organic, hydrophobic hydrocarbon group containing 8 – 40 carbon atoms and $R_2$ is hydrogen, lower alkyl or is the same as $R_1$.

2. A sizing agent according to claim 1 wherein $R_1$ is an alkyl group comprising 12 – 30 carbon atoms and $R_2$ is hydrogen, lower alkyl or is the same as $R_1$.

3. A sizing agent according to claim 1 wherein the emulsifier is a cationic compound.

4. A sizing agent as set forth in claim 2 wherein the emulsifier is a cationic compound.

* * * * *

UNITED STATES PATENT OFFICE
CERTIFICATE OF CORRECTION

PATENT NO. : 3,966,484
DATED : June 29, 1976
INVENTOR(S) : KARIN ULLA ELISABET HELMER and ALF RAGNAR REUTERHALL It is certified that error appears in the above-identified patent and that said Letters Patent are hereby corrected as shown below:

[30] Foreign Application Priority Data

November 16, 1971 Sweden.....12622/71

Signed and Sealed this

Twenty-first Day of September 1976

[SEAL]

*Attest:*

RUTH C. MASON
*Attesting Officer*

C. MARSHALL DANN
*Commissioner of Patents and Trademarks*